US008955836B2

(12) United States Patent
Jones

(10) Patent No.: US 8,955,836 B2
(45) Date of Patent: Feb. 17, 2015

(54) OUTPUT TRAY NUDGING MECHANISM

(75) Inventor: Brent Rodney Jones, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 1058 days.

(21) Appl. No.: 11/960,324

(22) Filed: Dec. 19, 2007

(65) Prior Publication Data

US 2009/0160123 A1 Jun. 25, 2009

(51) Int. Cl.

| | |
|---|---|
| ***B65H 31/00*** | (2006.01) |
| ***B65H 29/38*** | (2006.01) |
| ***B65H 31/30*** | (2006.01) |
| ***G03G 15/00*** | (2006.01) |

(52) U.S. Cl.

CPC ..... *B65H 31/3081* (2013.01); *G03G 15/6547* (2013.01); *B65H 2301/42266* (2013.01); *B65H 2402/443* (2013.01); *B65H 2601/325* (2013.01); *B65H 2601/523* (2013.01); *B65H 2801/12* (2013.01)

USPC ..... 271/207; 271/177; 414/790.1

(58) Field of Classification Search

USPC ..... 271/207, 220, 9.11, 177, 178, 221, 271/3.03; 414/790.3

See application file for complete search history.

(56) References Cited

U.S. PATENT DOCUMENTS

| | | | | |
|---|---|---|---|---|
| 4,322,068 | A * | 3/1982 | Cayn et al. | 271/207 |
| 4,481,751 | A * | 11/1984 | Ujhelyi | 53/412 |
| 4,518,300 | A * | 5/1985 | Kent | 414/790.3 |
| 5,662,320 | A * | 9/1997 | Fujiwara et al. | 271/3.14 |
| 5,722,650 | A * | 3/1998 | Yamamoto et al. | 270/58.02 |
| 5,758,981 | A | 6/1998 | Lesniak et al. | |
| 5,774,778 | A * | 6/1998 | Adachi et al. | 399/403 |
| 5,836,579 | A * | 11/1998 | Hayashi et al. | 270/58.16 |
| 5,839,048 | A * | 11/1998 | Kato | 399/407 |
| 5,897,110 | A * | 4/1999 | Fujiwara | 271/4.01 |
| 6,076,825 | A * | 6/2000 | Kato et al. | 271/207 |
| 6,085,913 | A * | 7/2000 | Aiko et al. | 209/540 |
| 6,209,865 | B1 * | 4/2001 | Regimbal et al. | 271/220 |
| 6,394,442 | B1 | 5/2002 | Antinora et al. | |
| 6,889,974 | B2 * | 5/2005 | Tamura et al. | 271/220 |
| 7,093,992 | B2 | 8/2006 | Zeller et al. | |
| 7,237,774 | B2 * | 7/2007 | Fukatsu et al. | 271/207 |
| 7,431,289 | B2 * | 10/2008 | Sekiyama et al. | 271/188 |
| 7,537,209 | B2 * | 5/2009 | Kato et al. | 271/220 |
| 7,637,502 | B2 * | 12/2009 | Ata et al. | 271/303 |
| 2005/0035522 | A1 * | 2/2005 | Gonzalez et al. | 271/1 |
| 2006/0071423 | A1 * | 4/2006 | Ata et al. | 271/303 |
| 2007/0273088 | A1 * | 11/2007 | Ong et al. | 271/207 |

FOREIGN PATENT DOCUMENTS

| | | | | |
|---|---|---|---|---|
| JP | 62046863 | * | 2/1987 | B65H 33/08 |
| JP | 03111372 | * | 5/1991 | B65H 29/48 |

* cited by examiner

*Primary Examiner* — Patrick Cicchino

(74) *Attorney, Agent, or Firm* — Maginot Moore & Beck LLP

(57) ABSTRACT

A printing device includes a recessed output tray having a nudging mechanism including a nudger component that engages a stack of paper such that when the nudger moves, the stack will move with it and an actuating mechanism to move the nudger, thereby moving the stack of papers. The nudger may be automatic or may be controlled manually. The stack may be moved in a particular direction or may be rotated.

18 Claims, 10 Drawing Sheets

OUTPUT TRAY NUDGING MECHANISM

The embodiments disclosed herein relate to printing devices, and more specifically to document retrieval from and the document output trays of such devices.

One of the trends in office work group printing devices is size reduction. While print speeds, image quality and media handling features, such as input/output tray capacity, are becoming greater, sales prices are being forced down. Lower prices encourage product placement on desks or small office table tops, which further influences printing device working envelopes to be as small as reasonably possible. Extending media output trays take up valuable space and there is a broad goal of incorporating the output tray largely internal to the product enclosure. This solves one customer problem but creates another, as the now crowded, limited access tray appears more like a tunnel than an easy to see and access print retrieval tray. Access from a concurrently exposed end may not be possible if the product is configured with an optional finisher. The media path is often inset to the extent that the exposed edge of the output media may end up to several inches from the exterior surface of the side of the unit offering access.

It would be desirable if the user had easier access to the media output of printing devices having recessed document output trays.

The embodiments disclosed herein describe a media stack access enhancement nudger that shifts the media closer to the exposed grasping area in a limited access output tray. The nudger may slide a media stack in a linear direction to be grasped for removal or may pivot the stack outward to make one or the other end of the stack more accessible.

Embodiments of the present invention include a printing device having a recessed output tray. The output tray includes a nudging mechanism including a nudger that engages a stack of paper such that when the nudger moves, the stack will move with it and an actuating mechanism to move the nudger, thereby moving the stack of papers.

Embodiments also include a printing method that includes printing a document, and moving or rotating the document in an outward direction from the somewhat inward location from which they exit a printing device so that the document may be retrieved more easily.

Various exemplary embodiments will be described in detail, with reference to the following figures.

Figure 1:
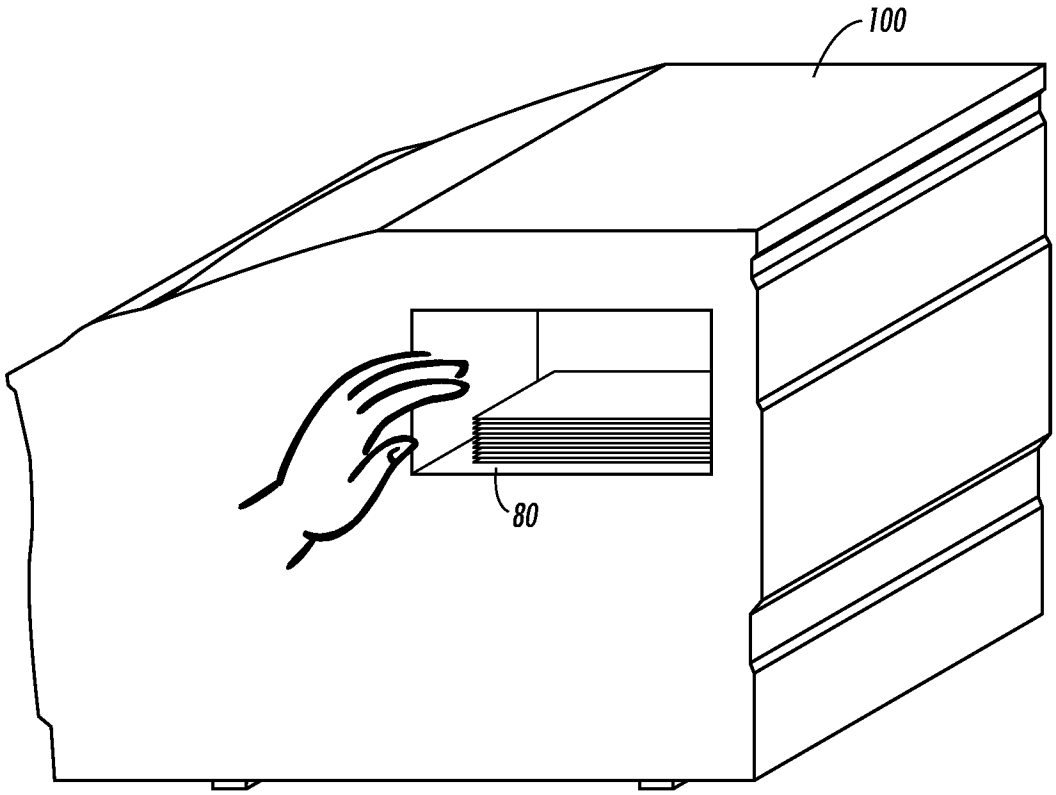

FIG. 1 is a schematic illustration of a recessed output tray of a printing device.

Figure 2:
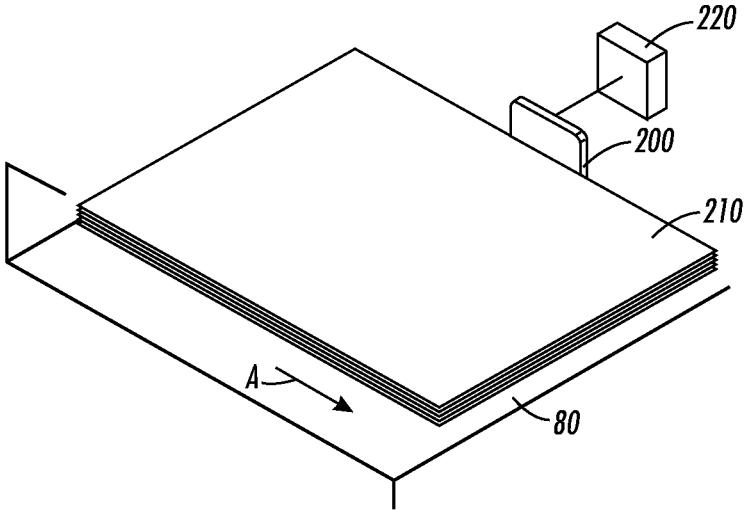

FIG. 2 schematically shows a first exemplary embodiment of a nudging mechanism in a first position.

Figure 3:
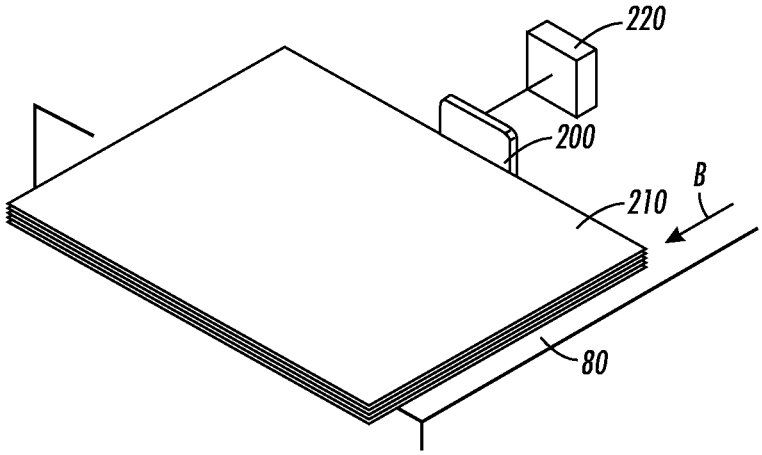

FIG. 3 schematically shows the nudging mechanism of FIG. 2 in a second position.

Figure 4:
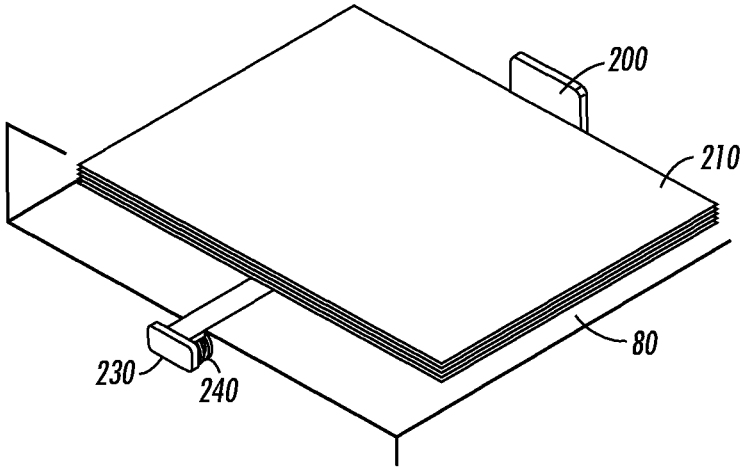

FIG. 4 schematically shows a second exemplary embodiment of a nudging mechanism in a first position.

Figure 5:
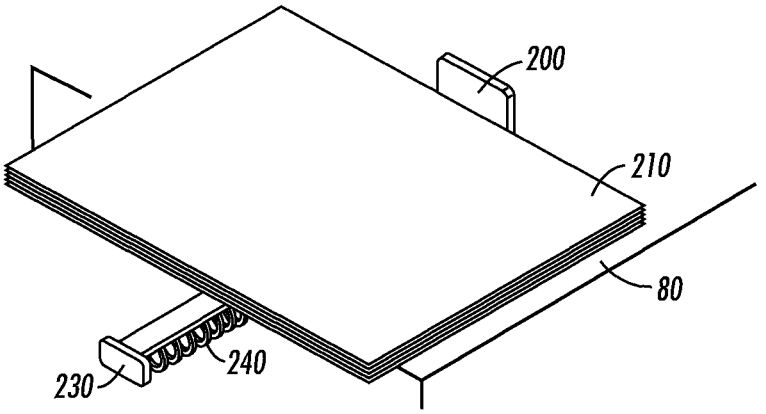

FIG. 5 schematically shows the nudging mechanism of FIG. 4 in a second position.

Figure 6:
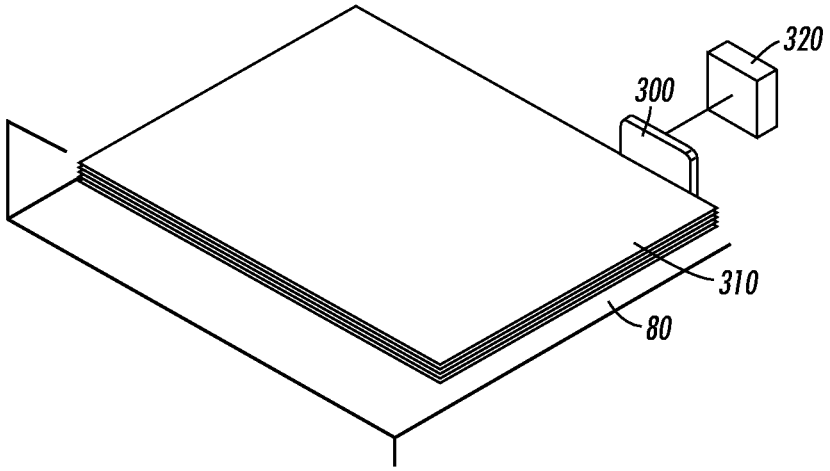

FIG. 6 schematically shows a third exemplary embodiment of a nudging mechanism in a first position.

Figure 7:
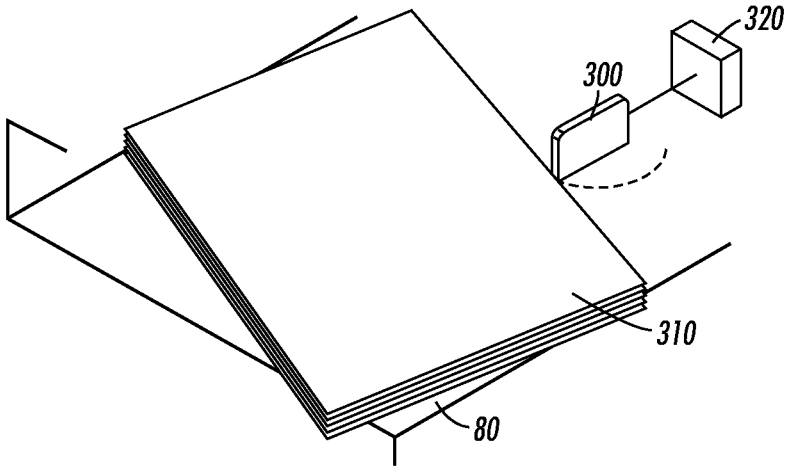

FIG. 7 schematically shows the nudging mechanism of FIG. 6 in a second position.

Figure 8:
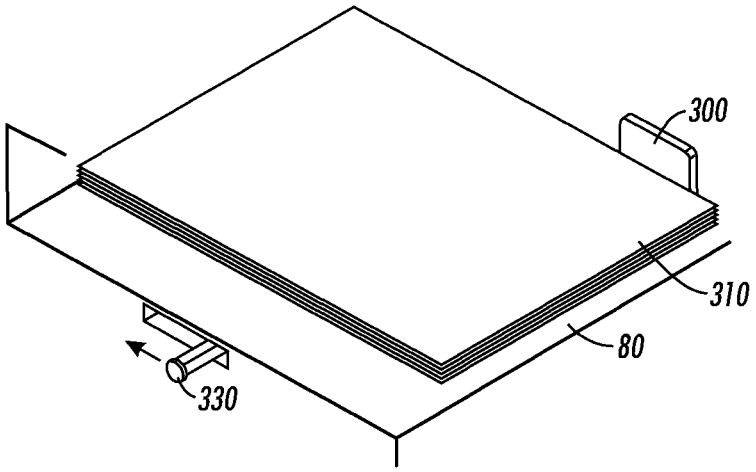

FIG. 8 schematically shows a fourth exemplary embodiment of a nudging mechanism in a first position.

Figure 9:
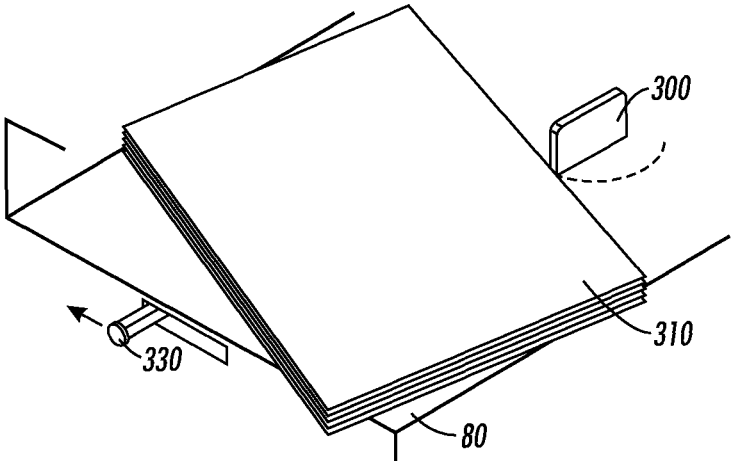

FIG. 9 schematically shows the nudging mechanism of FIG. 8 in a second position.

Figure 10:
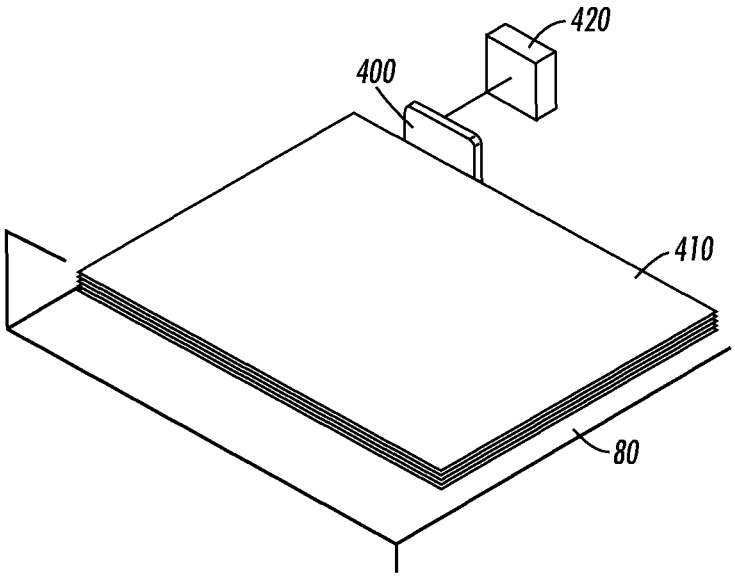

FIG. 10 schematically shows a fifth exemplary embodiment of a nudging mechanism in a first position.

Figure 11:
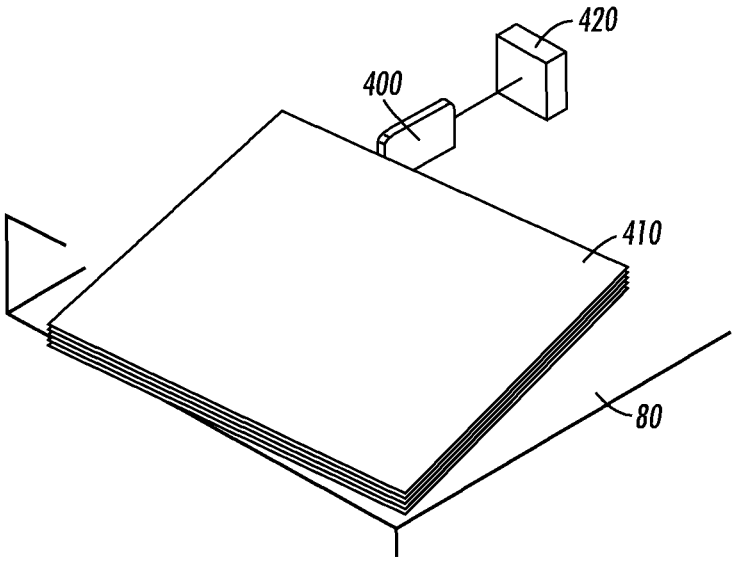

FIG. 11 schematically shows the nudging mechanism of FIG. 10 in a second position.

Figure 12:
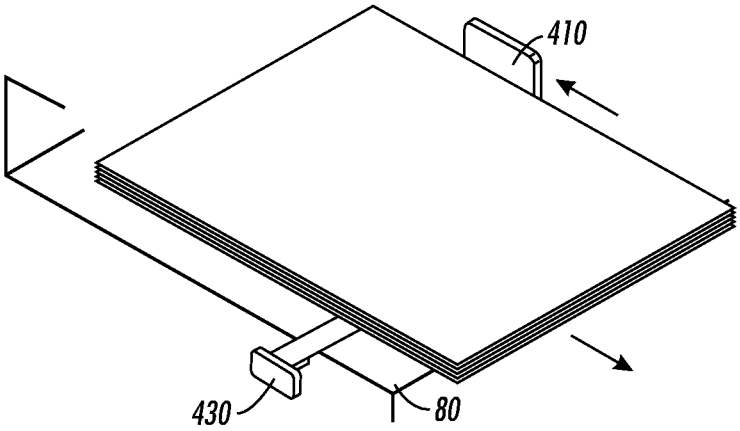

FIG. 12 schematically shows a sixth exemplary embodiment of a nudging mechanism in a first position.

Figure 13:
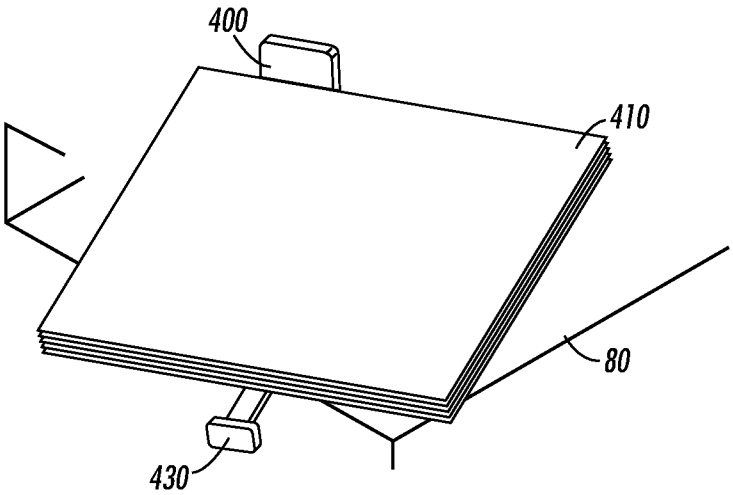

FIG. 13 schematically shows the nudging mechanism of FIG. 12 in a second position.

Figure 14:
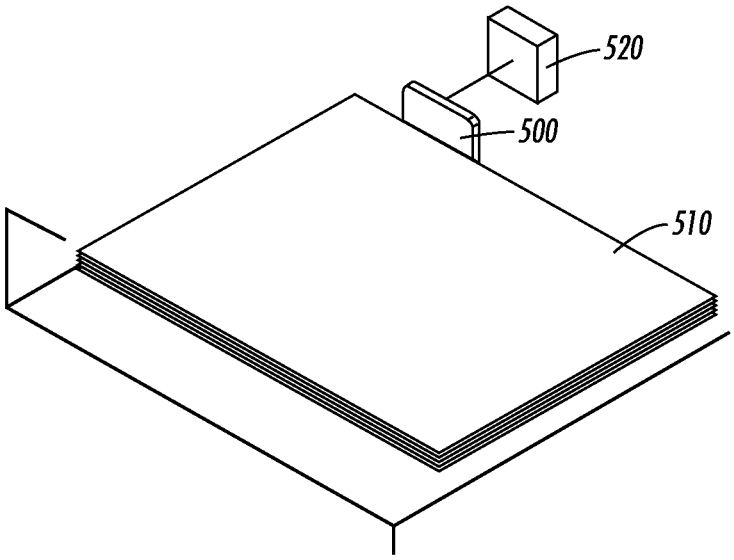

FIG. 14 schematically shows a seventh exemplary embodiment of a nudging mechanism in a first position.

Figure 15:
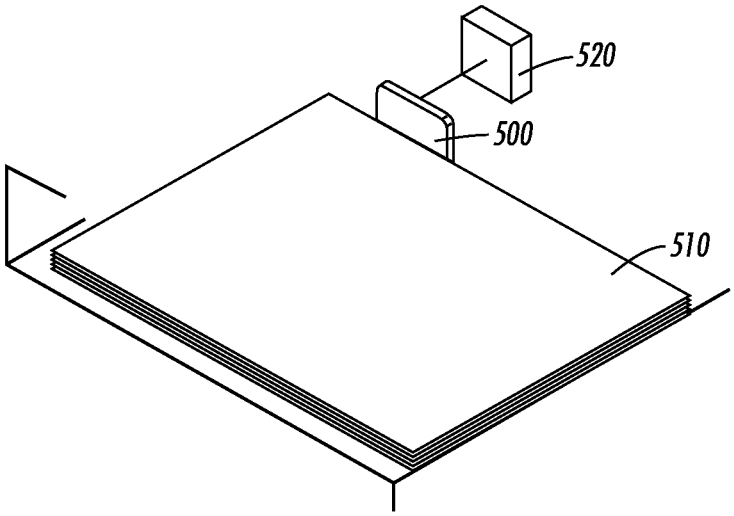

FIG. 15 schematically shows the nudging mechanism of FIG. 14 in a second position.

Figure 16:
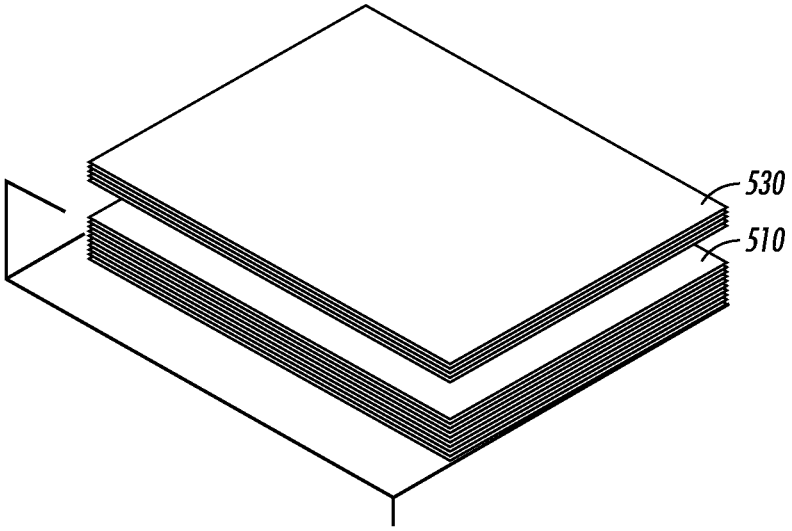

FIG. 16 schematically shows an output tray with offset sheet stacks thereon.

Figure 17:
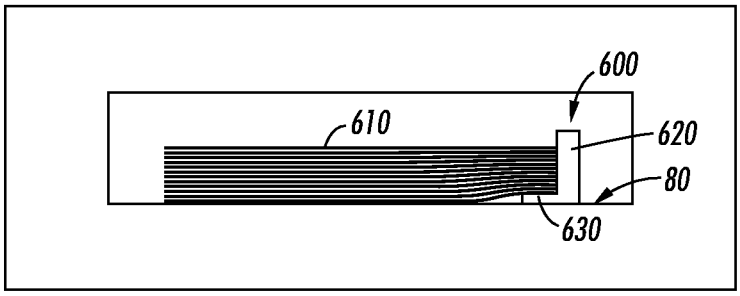

FIG. 17 schematically shows an exemplary embodiment of a nudger including an underside component in a first position.

Figure 18:
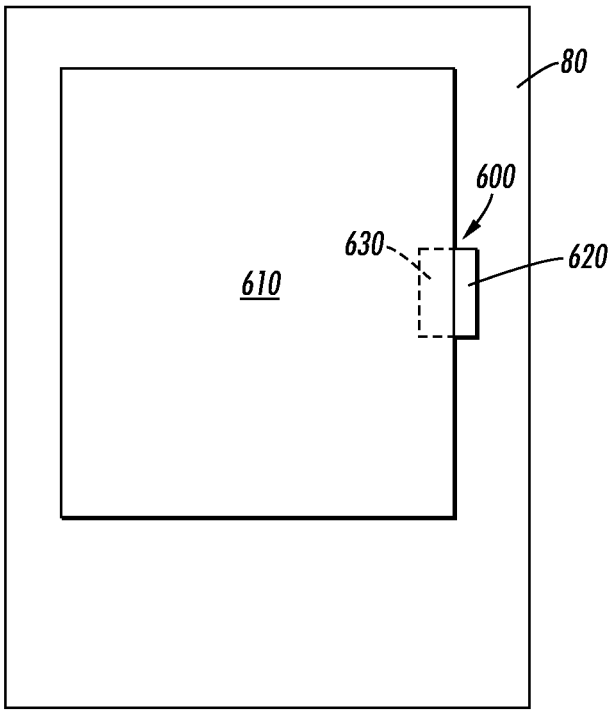

FIG. 18 schematically shows the nudger of FIG. 17 from an overhead view.

The term "printing device" as used herein refers to devices that produce hardcopy documents. Printing devices include, for example, copiers, printers and multi-function devices. Paper, as used herein, refers to any markable media such as, for example, paper, plastic, and textile materials.

The embodiments described herein are suited for use in many different printing devices as well as in any other system outputting a sequence of sheets.

FIG. 1 illustrates an exemplary embodiment of a printing device 100. FIG. 1 illustrates an external view of the printer 100 and its document output area 80. The document output area 80 is recessed. In devices where the output tray is recessed, the user has increased difficulty in removing output sheets. A mechanism or method of making the output paper more accessible would be helpful to the user. Particularly, a mechanism that would move a paper or stack of papers out of the recessed area or at least to a more accessible area would be helpful.

One method of making output documents more accessible includes using a nudging mechanism. The nudging mechanism could include a nudger that moves an output document stack in an outward vector, including a substantially linear manner, in the direction from which the user would retrieve the document stack. Alternatively, the nudger may rotate or pivot the document stack so that one end is easier to grasp by the user. The nudger may be centered on the media edge for the size having the highest use volume (A, A4 for letter size printing devices) sufficiently to slide as a stack in the direction of the nudger movement or may be positioned off center so that the nudge would result in rotating or pivoting a stack of typically sized media. Combinations of the sliding and rotating motion may also be useful. The nudging mechanism could also include a riser or fence that is able to move a media stack by being equal or greater in height than the possible stack or by being sufficiently high relative to a media stack that media engaged by the riser or fence is collectively stiff enough to cause media above to move in concert. The nudging mechanism may also enable manually offsetting print jobs or more easily shifting smaller size media, such as cards or envelopes, by using a nudger with intermediate stationary adjustments.

The nudger does not need to move the media edge all the way to or past the edge of the inset. The benefit of the nudger is to make media easier to retrieve by bringing it close enough to the outer enclosure that visibility and grasping are noticeably improved. Opening height, depth of media position, and contours or shape of the enclosure forming the tray opening influence the travel required to achieve this objective.

FIGS. 2-15 illustrate various exemplary embodiments of a nudging mechanism.

FIGS. 2 and 3 illustrate a first exemplary embodiment of a nudging mechanism. The sheets are shown having exited a printing device in a direction indicated by Arrow A. In this embodiment, a nudger 200 pushes a stack 210 in a substantially linear direction. In this embodiment, the nudger 200 is connected to a controller 220. The controller 220 could automatically shove the stack in the direction of arrow B when, for example, the print job was finished or when the stack height got too high. In addition, FIGS. 2 and 3 show that direction B is substantially perpendicular to the direction of paper output as indicated by arrow A. For many devices, the user will typically be retrieving documents from a side angle so the nudging mechanism will generally be designed to move a document stack or part of a document stack in a direction substantially perpendicular to the output direction. The controller 220 could be a device controller independent of a user that automatically nudges output documents toward a user access opening where a user may retrieve the document. The controller 220 could also be a local controller that activates when a user activates it such as, for example, by pressing a button or flipping a switch readily accessible or associated with the tray.

Alternatively, pivoting, pushing, pulling or sliding a lever or knob accessible from the printing device outer surface, and preferably close to the output tray, could actuate a manual stack nudger directly or through a link or flexible cable. The manually actuated nudger would ideally have a spring return action for the lever that would leave the media stack in the shifted position so actuation and media retrieval would involve only two operations.

FIGS. 4 and 5 illustrate a second exemplary embodiment of the present invention similar to the first exemplary embodiment, but where the nudger is operated manually. In FIGS. 4 and 5, lever 230 operably connects to nudger 200, and may be used to move nudger 200, which in turn moves stack 210. The lever could either be a simple mechanical lever or be electromechanical in nature. The lever mechanism may include, for example, a slide, a pivot, or a rotating cam to move the nudger. After the lever is used to move the stack closer to a user's grasp, the lever would return the nudger to its original position. The lever may also optionally be spring-loaded as shown in FIGS. 4 and 5. Spring 240 will cause the lever 240 and nudger 200 to return to their original non-extended positions.

FIGS. 6 and 7 illustrate a third exemplary embodiment of the present invention. In this embodiment, the nudging mechanism rotates the stack. The nudger will typically rotate the stack by an angle between 0° and 90°. The nudging mechanism 300 can be positioned off-center so that it pushes one end of a stack of papers 310. In FIGS. 6-9, this offset is toward the leading edge of the exiting sheet stack. However, this offset may also be shown as closer to the trailing edge of the sheet stack (as shown in FIGS. 10-13). In embodiments, the nudging mechanism rotates the stack about a pivot point.

As can be seen in FIG. 7, the nudging mechanism could also rotate. Rotating the nudger would generally translate the stack, when the nudger is roughly centered on a stack. Rotating the nudger may also help guide the rotation of a stack when the nudger is located off-center if it is more distant from the pivot point.

In the embodiment shown in FIGS. 6 and 7, a controller 320 is used to control the nudging mechanism 300. Similarly to the first exemplary embodiment, the controller 320 may be a device controller that automatically rotates the stack with no human intervention. It may also be a local controller that responds to a user activation of some kind, such as a switch or button.

FIGS. 8 and 9 illustrate a fourth exemplary embodiment similar to the third exemplary embodiment. In this case, a lever 330 is used to manually move the nudging mechanism 300.

FIGS. 10 and 11 and 12 and 13 illustrate fifth and sixth exemplary embodiments of the present invention. These embodiments combine the features of translational and rotational movement. The nudger 400 moves the stack 410 forward and rotates the stack as well. In the exemplary embodiment shown in FIGS. 10 and 11 a controller 420 actuates the nudger 400. FIGS. 12 and 13 shows an exemplary embodiment that includes a lever 430 to both rotate and translate the stack.

An additional alternative to orthogonal travel is a nudger that travels at an angle so it shifts the media stack in two axes. An automated nudger has the potential added benefits of being used as a stack off-setter. When used to separate print jobs by offsetting, it may be desirable for the media stack to follow the nudger both outward and inward so that multiple jobs can be offset. Technically, this two-directional movement could be done manually as well, although it may not be as valuable in routine printing applications as the user would necessarily be there to remove the particular stack being offset in person.

FIGS. 14-15 illustrate an exemplary embodiment of a nudger that can move a document in two directions. FIG. 14 illustrates a nudger 500 that pushes a stack 510. A controller 520 actuates the nudger 500, which controller 520 may be a local controller or a device controller. In FIG. 15, the stack has moved diagonally, that is it has moved in both the direction it exited the printing device 100 and in a direction substantially perpendicular to that direction. Moving the stack in such a manner could help offset output documents. The next document 530 produced exits offset from the first stack 510 as shown in FIG. 16.

To help facilitate movement of a stack, a nudger may include an underside support that aids in controlling the media during a shift. FIGS. 17 and 18 illustrate such a nudger 600. FIG. 17 is a schematic drawing of an end view of an output tray. FIG. 18 is an overhead of the tray. Nudger 600 has a component 620 substantially parallel to the edge of the stack 610 as well as a component 630 substantially parallel to the surface of the exiting sheets. Extending underneath the sheets helps overcome the friction between the sheets and the surface of the output tray. The size of the vertical 620 and horizontal 630 components of nudger 600 may be as big as necessary to easily move the sheets in question. The underside portion 630 may be wider or extend further out than shown in FIGS. 17 and 18. The nudger 600 would, for example, ease movement of the stack in the embodiments shown in FIGS. 3-16 and described herein. In particular, the diagonal movement illustrated in FIGS. 15 and 16 would be substantially easier with a nudger that contacted the bottom surface of a stack of paper.

Nudgers that ensure movement of the media when pushing it may be augmented with complementary features that also allow the greater portion of a stack that is not retrieved to be retracted to the normal position without significant unintended displacement or orientation of the media. The underside support portion may assist in implementations capable of job offsets as the media would more readily tend to remain in an orderly stack.

A nudging mechanism is especially helpful if the printing device in question outputs a variety of paper sizes. A printing device may produce a gamut of sizes from oversized envelopes to postcard-sized outputs. If it has a recessed output tray, retrieving the smaller postcard-sized media may be difficult. The nudging mechanism may be used especially or solely for particularly small paper sizes and not used for the larger sized sheets of paper. A nudger may be designed to allow adjustment for alternative or particular media sizes. The adjustment may be facilitated by components that permit the adjustment of the nudger without otherwise affecting nudger displacement or travel. The media output nudging configuration may incorporate movement of any or a combination of vectors or pivots and may include one or more nudging risers and/or bottom supports of any configuration, including position adjustments for various size media. The nudger may be designed to have multiple ranges of travel so that it moves a shorter distance or rotation for typical A or A4 paper and a longer distance or rotation for smaller size media. The terms pivot and rotate, as used herein, are intended to encompass any non-linear path, such as arc, radial, or curved motion.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

We claim the following:

1. A printing device comprising:

a single housing having an opening in a wall of the single housing;

an output tray located within the single housing and positioned proximate the opening in the single housing, the output tray being configured to hold printed media within a perimeter of the single housing;

a nudging mechanism having a nudger proximate the output tray and positioned to engage printed media resting entirely within the output tray; and an actuating mechanism configured to move the nudger in a direction towards the opening in the single housing to move at least a portion of the printed media resting entirely in the output tray to the opening in the single housing to facilitate removal of the printed media from the output tray through the opening in the housing.

2. The printing device of claim 1, the actuating mechanism being further configured to rotate the nudger about a pivot to rotate the printed media resting entirely within the output tray and move a corner of the printed media to the opening in the housing.

3. The printing device of claim 1, the actuating mechanism being further configured to move the nudger in a linear direction that is perpendicular to a media path within the single housing that terminates into the output tray.

4. The printing device of claim 3, the nudger being further configured to engage the printed media resting entirely within the output tray at a trailing edge or a leading edge of the printed media and the actuating mechanism is further configured to rotate the nudger about a pivot.

5. The printing device of claim 1, the nudger being further configured to adjust a position of the nudger with reference to an edge of the output tray to alter selectively the position at which the nudger engages the printed media resting entirely in the output tray.

6. The printing device of claim 1, the nudger being further configured to engage printed media at a trailing edge or a leading edge of the printed media and the actuating mechanism is further configured to rotate the nudger to rotate the printed media in the output tray and move the at least a portion of the printed media to the opening in the single housing.

7. The printing device of claim 1, wherein the nudger is located proximate the output tray at a position that is off-center with respect to a side edge of the printed media in the output tray and the nudger being further configured to rotate the printed media in response to the actuating mechanism moving the nudger.

8. The printing device of claim 1, the actuating mechanism further comprising a controller operatively connected to the nudger to move the nudger selectively.

9. The printing device of claim 8, the controller being further configured to move the nudger in response to particular criteria being met.

10. The printing device of claim 8, the controller being further configured to move the nudger automatically in response to a print job being complete.

11. The printing device of claim 8, the controller being further configured to move the nudger automatically in response to the printed media resting entirely within the output tray reaching a predetermined height.

12. The printing device of claim 8, the controller being further configured to move the nudger automatically in response to a request being received from a user.

13. A printing method for use in a printing device with a recessed document retrieval area, comprising:

printing a document with a printing device located within a single housing;

sending the printed document to a document retrieval area recessed within the single housing, the document retrieval area being located at a terminal end of a document path within the single housing; and moving the printed document in the document retrieval area in a direction different from the direction from which the document entered the recessed document retrieval area to position the document nearer an opening in the single housing to facilitate retrieval of the document from the document retrieval area recessed within the single housing.

14. The method of claim 13, the printed document movement further comprising:

rotating a nudger positioned proximate the document retrieval area recessed within the single housing to rotate the document and move a portion of the document nearer the opening in the single housing.

15. The method of claim 13, the movement of the document being done automatically in response to a print job being completed.

16. A printing method for use in a printing device with a recessed document retrieval area, comprising:

printing a document with a printing device located within a single housing;

sending the printed document to a document retrieval area recessed within the single housing, the document retrieval area being located at a terminal end of a document path within the single housing; and rotating the printed document in the document retrieval area to position a portion of the printed document nearer an opening in the single housing through which the printed document is retrieved from the document retrieval area.

17. The method of claim 16, the rotation of the printed document further comprises: rotating a plurality of documents in the document retrieval area in response to the plurality of documents reaching a predetermined height.

18. The method of claim 16, the rotation of the printed document further comprises: rotating the printed document in response to a print job being completed.

* * * * *